US011408132B2

(12) United States Patent
Logan et al.

(10) Patent No.: US 11,408,132 B2
(45) Date of Patent: Aug. 9, 2022

(54) PEDESTAL MOUNTED PAVER HEATING SYSTEM

(71) Applicant: nVent Services GmbH, Schaffhausen (CH)

(72) Inventors: Stephen Logan, Cameron Park, CA (US); Sudhir Thorat, Dublin, CA (US); Craig Drake, Suffield, CT (US)

(73) Assignee: nVent Services GmbH, Schaffhausen (CH)

( * ) Notice: Subject to any disclaimer, the term of this patent is extended or adjusted under 35 U.S.C. 154(b) by 502 days.

(21) Appl. No.: 16/162,331

(22) Filed: Oct. 16, 2018

(65) Prior Publication Data

US 2019/0112767 A1 Apr. 18, 2019

Related U.S. Application Data

(60) Provisional application No. 62/572,968, filed on Oct. 16, 2017.

(51) Int. Cl.
*H05B 3/20* (2006.01)
*F24D 13/02* (2006.01)
(Continued)

(52) U.S. Cl.
CPC ..... *E01C 11/265* (2013.01); *E01C 5/001* (2013.01); *E01C 5/006* (2013.01); *E01C 5/065* (2013.01); *E01C 5/16* (2013.01); *E01C 5/223* (2013.01); *E04F 15/02417* (2013.01); *E04F 15/02464* (2013.01); *F24D 13/024* (2013.01); *F24D 19/1096* (2013.01); *H05B 1/0227* (2013.01); *H05B 3/18* (2013.01); *H05B 3/46* (2013.01);
(Continued)

(58) Field of Classification Search
CPC ..... H05B 3/56–565; H05B 3/20–30; H05B 2203/026; F24D 13/02–024; E01C 11/265
See application file for complete search history.

(56) References Cited

U.S. PATENT DOCUMENTS 3,806,702 A 4/1974 Spencer
3,904,847 A 9/1975 Adams
(Continued)

FOREIGN PATENT DOCUMENTS

CA 2482519 A1 3/2006
EP 2679915 A1 1/2014
(Continued)

OTHER PUBLICATIONS

Electric Resistance Pedestal Paver Snow Melt Data Sheet, Copyright 2016 Heatizon Systems, 1 page.
(Continued)

*Primary Examiner* — Michael A Laflame, Jr.
(74) *Attorney, Agent, or Firm* — Quarles & Brady LLP

(57) ABSTRACT

Some deck or patio areas constructed of pavers mounted on adjustable pedestal supports must remain snow and ice free on their top surfaces. The pedestal-mounted paver heating system is designed to allow easy installation of electric heating cable that is positioned against the bottom surface of pavers so that heat generated by the cable is efficiently transferred up into the pavers to raise their temperature enough to prevent the accumulation of snow and ice on their top surfaces.

14 Claims, 17 Drawing Sheets

(51) Int. Cl.

| | |
|---|---|
| ***E01C 11/26*** | (2006.01) |
| ***E01C 5/06*** | (2006.01) |
| ***H05B 3/18*** | (2006.01) |
| ***H05B 3/56*** | (2006.01) |
| ***E01C 5/00*** | (2006.01) |
| ***H05B 1/02*** | (2006.01) |
| ***F24D 19/10*** | (2006.01) |
| ***E04F 15/024*** | (2006.01) |
| ***H05B 3/46*** | (2006.01) |
| ***E01C 5/22*** | (2006.01) |
| ***E01C 5/16*** | (2006.01) |
| *E04F 15/02* | (2006.01) |

(52) U.S. Cl.

CPC ..... *H05B 3/56* (2013.01); *E01C 2201/00* (2013.01); *E04F 2015/02105* (2013.01); *E04F 2290/023* (2013.01); *F24D 2220/2081* (2013.01); *H05B 2203/003* (2013.01); *H05B 2203/026* (2013.01)

(56) References Cited

U.S. PATENT DOCUMENTS

| | | | | |
|---|---|---|---|---|
| 4,564,745 | A | 1/1986 | Deschenes | |
| 4,814,580 | A | 3/1989 | Carageorge | |
| 5,003,157 | A | 3/1991 | Hargrove | |
| 5,550,350 | A | 8/1996 | Barnes | |
| 6,061,982 | A | 5/2000 | Owen | |
| 6,127,653 | A | 10/2000 | Samuels | |
| 6,438,909 | B2 | 8/2002 | Birch et al. | |
| 6,715,956 | B1 | 4/2004 | Weber et al. | |
| 8,453,391 | B2 | 6/2013 | Tabibnia | |
| 8,550,744 | B1 | 10/2013 | Lee | |
| 8,850,753 | B2 | 10/2014 | Tabibnia | |
| 8,952,301 | B2 | 2/2015 | Naylor et al. | |
| 9,188,348 | B2 | 11/2015 | Larson | |
| 9,271,334 | B2 | 2/2016 | Fu | |
| 9,410,296 | B2 | 8/2016 | Tabibnia | |
| 2004/0035853 | A1* | 2/2004 | Pais | E01C 11/265 219/548 |
| 2012/0067868 | A1 | 3/2012 | Casey | |
| 2013/0119043 | A1 | 5/2013 | Consiglio et al. | |
| 2014/0001170 | A1* | 1/2014 | Son | B32B 37/18 219/209 |
| 2014/0220874 | A1 | 8/2014 | Meyer | |
| 2015/0034067 | A1 | 2/2015 | Szekely | |
| 2017/0260699 | A1 | 9/2017 | Tabibnia | |
| 2017/0325292 | A1* | 11/2017 | Bench | H05B 3/56 |
| 2017/0325295 | A1 | 11/2017 | Shibuya et al. | |

FOREIGN PATENT DOCUMENTS

| | | | |
|---|---|---|---|
| FR | 2681753 | A1 | 3/1993 |
| KR | 20130020967 | A | 3/2013 |
| KR | 20140110310 | A | 9/2014 |
| WO | 2008043478 | A2 | 4/2008 |

OTHER PUBLICATIONS

Heatizon Pedestal Paver Pan Installation Guide, Heatizon Systems Radiant Heating and Snow Melting Systems, copyright 2017 Heatizon Systems, 7 pages.

Floor Heating Systems Offer Raychem Underfloor Heating Systems, Architecture & Design, Nov. 2, 2019, 5 pages.

Tile Tech Pavers; Hex-Tray Snow Melt System; Paver Snow Melt System Details, Plan and Profile View; Copypright 2010-2015; 1 page.

Tile Tech Pedestal; UNI-JUST & STAK-CAP Pedestal System; Hybrid Pedestal System Technical Details; Copyright 2015; 28 pages.

* cited by examiner

PEDESTAL MOUNTED PAVER HEATING SYSTEM

CROSS-REFERENCE TO RELATED APPLICATIONS

This application is a non-provisional and claims the benefit of U.S. Prov. Pat. App. Ser. No. 62/572,968, filed under the same title on Oct. 16, 2017, and incorporated herein in its entirety by reference.

BACKGROUND

Pavers are commonly used for constructing decks or patios where people stand or walk. During winter it is often important these areas remain snow and ice free on their top surfaces to prevent people slipping or falling. The paver material composing these areas often has a low specific heat capacity, meaning they are prone to the collection of snow and ice. While snow can be removed by manually shoveling it off the paver, this can be a labor-intensive process. Ice accumulation is more difficult to address. One solution is applying an external heat source to the paver, though this may introduce additional difficulties. Uniform heating of the paver is important to ensure that the totality of ice is melted. A current solution features a support tray consisting of plumbing that can direct a heated fluid to melt snow or ice. This solution poses complications, as the plumbing components may need to be cut at termination points. The fluid must be heated and pumped through the system, requiring leak testing, an array of plumbing equipment (boiler, pumps, valves, gauges, etc.) to regulate the flow and heating of the fluid. A device for heating pavers in a uniform manner to melt snow and ice, which is also easy to install and maintain, is therefore necessary.

SUMMARY

The invention overcomes drawbacks of previous paver heating systems by providing a pedestal-mounted paver heating system that is modular, efficient, and simple to install, and protects the heating cable installed therein from mechanical damage. In one aspect, the invention provides a pedestal mounted paver heating (PMPH) system for heating one or more thermally conductive pavers installed on pedestals to form a walking surface. The PMPH system includes: a plurality of support trays each including a base formed of thermally conductive sheet metal and sized to rest on the pedestals beneath a corresponding paver of the one or more pavers, a plurality of thermally conductive supportive structures attached to the base and spaced apart from each other to form a plurality of slots, and an insulation layer disposed to reduce heat loss through the base; and, a self-regulating heater cable electrically connecting to a power supply and disposed within a first support tray and a second support tray of the plurality of support trays, the plurality of slots of the first support tray defining a path of the heater cable that positions the heater cable relative to the walking surface in order to efficiently transfer heat from the heater cable through the one or more pavers to the walking surface. The plurality of slots of the first support tray can have a slot width selected to: allow the heater cable to be fully inserted by a system installer into the plurality of slots, such that the heater cable does not contact a first paver, of the one or more pavers, installed over the first support tray; and, retain the heater cable within the plurality of slots. The slot width can further be selected to maximize contact of the heater cable with the plurality of supportive structures.

The first support tray can have a planar upper surface defined by the corresponding plurality of supportive structures and contacting, the corresponding paver installed over the first support tray; the corresponding base of the first support tray can include a first support wing and a second support wing each extending away from the corresponding plurality of supportive structures at the upper surface of the first support tray, the first support wing and the second support wing, contacting the pedestals and further defining the upper surface of the first support tray when the corresponding paver is installed over the first support tray. The first support wing and the second support wing can each: extend away from the corresponding plurality of supportive structures at an angle with respect to horizontal, such that the first and second support wings dispose the upper surface of the first support tray above the pedestals when the first support tray is positioned on the pedestals; and, be configured to flatten into a horizontal position and further define the upper surface when the corresponding paver is installed over the first support tray.

The PMPH system can further include a controller in electrical communication with one or both of the power supply and the heater cable, the controller comprising a processor and memory storing machine-readable program instructions that, when executed by the processor, cause the controller to receive control signals and energize and de-energize the heater cable in response to the control signals. The PMPH system can further include one or more sensors in electronic communication with the controller and configured to detect the presence of snow or ice on the walking surface and send one or more of the control signals to the controller.

The first support tray can further include two end pieces attaching to the base and extending parallel to each other across at least a portion of the base, the end pieces comprising a rigid material selected to stiffen the support tray sufficiently to support the corresponding paver. A first end piece of the two end pieces can be removable and re-attachable to the base, and the sheet metal of the base can be cut by a system installer, such that the first support tray can, at a location of the walking surface, be cut to a desired length to support a partial paver of the one or more pavers. The two end pieces can extend perpendicular to the corresponding plurality of supportive structures, and the corresponding plurality of supportive structures can be cut by the system installer at the location of the walking surface.

In another aspect, the invention provides a PMPH system including: an electric heating cable; a cable support tray configured to hold the electric heating cable in a fixed position; and, a plurality of wings coupled to the cable support tray and extending away from the cable support tray to contact a plurality of pedestals. The PMPH system can further include an insulation layer disposed within the cable support tray and having a plurality of slots configured to retain the electric heating cable and defining a path of the heating cable that positions the heating cable relative to a paver in order to efficiently transfer heat from the heating cable through the paver to a walking surface. The PMPH system can further include a cover layer disposed over the insulation layer and defining an upper surface that contacts the paver. The cover layer can include a plurality of cover members each formed of a thermally conductive metal; the cover members can include a top member having a top surface that forms part of the upper surface, and at least one side member extending into a corresponding slot of the plurality of slots. The PMPH system can further include a support bracket including the plurality of wings, the support bracket further including a base that receives the support tray when the PMPH system is installed. The support bracket can further include a first tension member and a second tension member connecting the base to a first wing of the plurality of wings, the first tension member being configured to flatten from an angled position to a horizontal position when a paver is installed over the support tray.

In yet another aspect, the invention provides a method for assembling a pedestal mounted paver heating system, the method including the steps of: arranging a first cable support tray on a first plurality of pedestals; positioning an electric heating cable within the first cable support tray; connecting the electric heating cable to a power supply; and, mounting a first paver on a top surface of the first cable support tray. Arranging the first cable support tray on the first plurality of pedestals can include the steps of: positioning a first support bracket on a first pair of the first plurality of pedestals; positioning a second support bracket on a second pair of the first plurality of pedestals; and, placing the first cable support tray on the first and second support brackets. The method can further include the steps of: arranging a second cable support tray on a second plurality of pedestals adjacent the first cable support tray; positioning the electric heating cable within the second cable support tray; and, mounting a second paver on a top surface of the second cable support tray.

DETAILED DESCRIPTION

Figure 1:
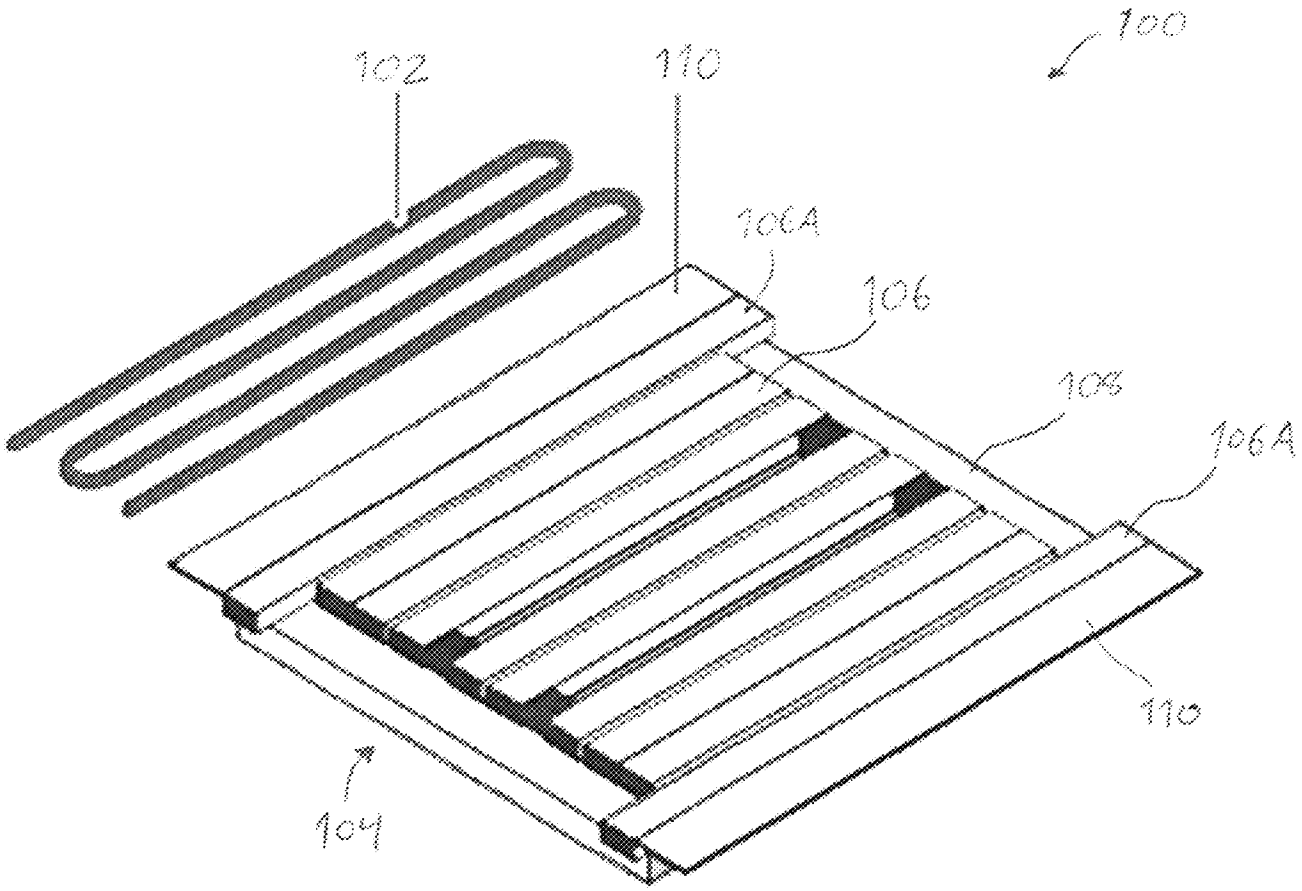
FIG. 1 shows an example embodiment of a heating cable and a support tray.

Before any embodiments are described in detail, it is to be understood that the invention is not limited in its application to the details of construction and the arrangement of components set forth in the following description or illustrated in the following drawings, which is limited only by the claims that follow the present disclosure. The invention is capable of other embodiments, and of being practiced, or of being carried out, in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted" "connected," "supported," and "coupled" and variations thereof are vised broadly and encompass both direct and indirect mountings, connections, supports, and couplings. Further, "connected" and "coupled" are not restricted to physical or mechanical connections or couplings.

The following description is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope, consistent with the principles and features disclosed herein. The following detailed description is to be read with reference to the figures, in which like elements in different figures have like reference numerals. Skilled artisans will recognize the examples provided herein have many useful alternatives and fall within the scope of embodiments of the invention.

Additionally, while the following discussion may describe features associated with specific devices, it is understood that additional devices and or features can be used with the described systems and methods, and that the discussed devices and features are used to provide examples of possible embodiments, without being limited.

The pedestal mounted paver heating (PMPH) System is designed to allow easy installation of electric heating cable that is positioned against the bottom surface of pavers so that heat generated by the cable is efficiently transferred up into the pavers to raise their temperature enough to prevent the accumulation of snow and ice on their top surfaces. The PMPH System generally comprises a heating cable and support tray which are placed on a series of pedestals to create a horizontal surface. Paver materials are then placed on the support tray to form a deck or patio. The PMPH system is designed to be modular, such that different combinations of support trays and pedestals may be used to create decks or patios in different sizes.

FIG. 1 shows an example embodiment of a PMPH system module 100 including a heating cable 102 and a support tray 104. In some embodiments, the support tray 104 can be an assembly including a base 108 and, in some embodiments, other formed parts made of sheet aluminum or a similar material. The tray 104 may have standard or customized horizontal dimensions that conform to the pavers used, and/or to rest firmly on pedestals at each of the corners of the tray 104. In some embodiments, the module 100 may include support wings 110, also formed of conductive sheet metal or similar material, and attached to or integral with the tray 104. The module 100 may include, contain, or support thermal insulation, such as one or more insulation panels or insulation layers, that is held in place within or against the tray 104 by adhesives, rivets, screws, or similar fasteners, as described further below.

The tray 104 is designed to route the cable 102 in a specific configuration and hold place relative to the paver. In some embodiments, the tray 104 can include thermally conductive supportive structures 106, such as rectangular extruded tubes, attached to or integral with the base 108. The heating cable 102 may be routed through the supportive structures 106 as described further below. The supportive structures 106 may include one or more extended tubes 106A at the edges of the tray 104, which are longer than the routing structures 106 and provide structural support to the tray 104 and the wings 110; in some embodiments, the extended tubes 106A are longer than the interior supportive structures 106 because, unlike the latter, the heating cable 102 does not need to be routed (e.g., in the serpentine pattern described below) around the extended tubes 106A at the edges of the tray 104.

Figure 2:
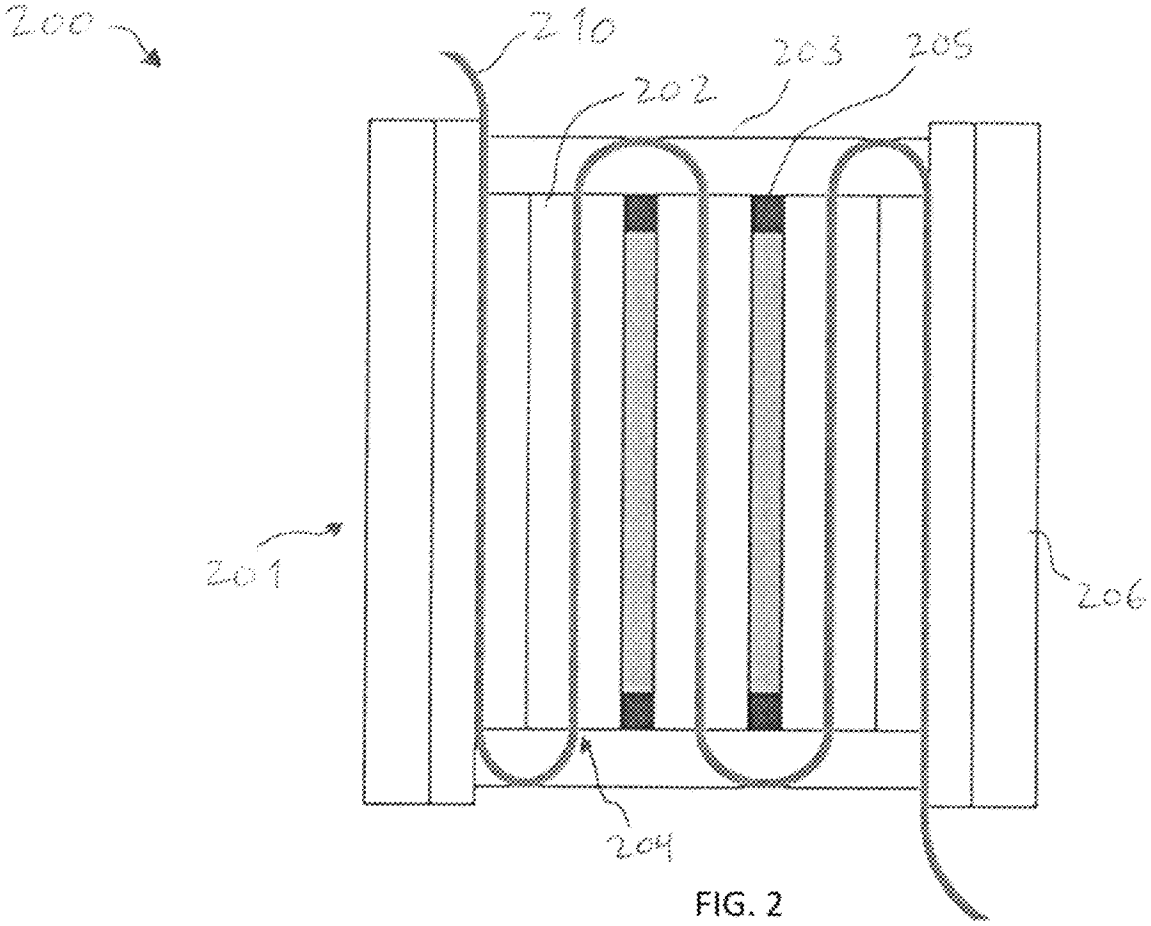
FIG. 2 is a top view of an example embodiment of a heating cable within a support tray.
Figure 3:
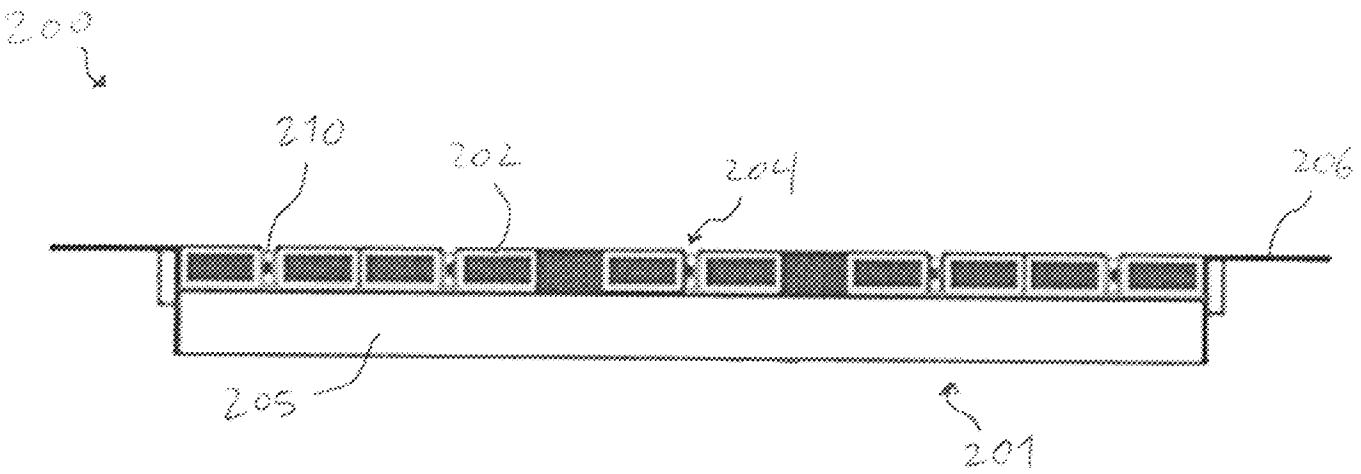
FIG. 3 is a side view of an example embodiment of a heating cable within a support tray.

FIGS. 2 and 3 show an example embodiment of a PMPH system module 200 with the heating cable 210 routed through the support tray 201. Supportive structures 202 within the support tray 201, fastened to metal crosspieces 203, provide a solid structural frame within which the heating cable 210 is routed. The supportive structures 202 are sized and spaced to form slots 204 between some or all of the adjacent supportive structures 202, in which slots 204 the heating cable 210 may be placed. The slots 204 may have a wall thickness (which in some embodiments may be determined by the wall thickness of the supportive structures 202 forming the slot) to provide an optimized balance between minimal weight and maximum heat transfer. Slots 204 in the tray 201 secure the cable 210 in a specific configuration to optimize heat transfer. The slots 204 are arranged to provide a specific slot width within which the heating cables 200 are placed. The width provides an optimized balance between ease of cable 210 installation and maximum cable 210 contact against the supportive structure 202 surfaces. The heating cable 210 positions across the width of the support tray 201 are specifically arranged to provide heat source points that will result in an evenly heated paver top surface. In certain embodiments, the two outermost slots 204 may be placed slightly closer to their adjacent slots 204 to mitigate the lack of a heat source beyond the outermost cable 210 or support tray 201. The slots 204 prevent the cable 210 from moving or changing configuration after installation. The aluminum slot 204 depth is sufficient to allow the heating cable 210 to be fully inserted and protected in a slot so that no portion of the cable 210 is exposed to physical damage, such as when a paver is placed on top. The support tray's 201 upper surface, defined by the upper surfaces of the supportive structures 202, provides a flat, unobstructed plane to maximize contact between the support tray 201 surface and the paver surface.

Underneath the tray is a section of insulation 205. The insulation 205 at the bottom minimizes the heat loss from the bottom surface and promotes heat transfer to the paver material above. This insulation 205 may be expanded foam cell insulation or other material that has insulating properties. Each tray 201 includes sections extending outward in a generally horizontal direction to form support wings 206 for the tray. During construction, the tray 201 is typically positioned on one or more pedestals to form a portion of the base of a deck or patio. See FIG. 5. In some embodiments, the angle, relative to horizontal, at which the support wings 206 extend from the tray may cause the upper surface of the tray (that supports the bottom surface of the paver), when first set upon the pedestals, to be slightly raised above the plane of the pedestal surfaces. After the heating cable 210 is installed, the paver is placed on top of the tray 201, pushing the tray down 201 and moving the support wings 206 into a horizontal position, held in a state of tension against the paver's bottom surface. In some embodiments, the support wings 206 are fabricated at an angle such that when a paver is placed on the tray 201, the support wings 206 are flattened into a generally horizontal position. For example, the angle may be within three degrees of horizontal, such as no more than one degree or no more than two degrees offset from horizontal, though other suitable angles are contemplated.

Figure 4:
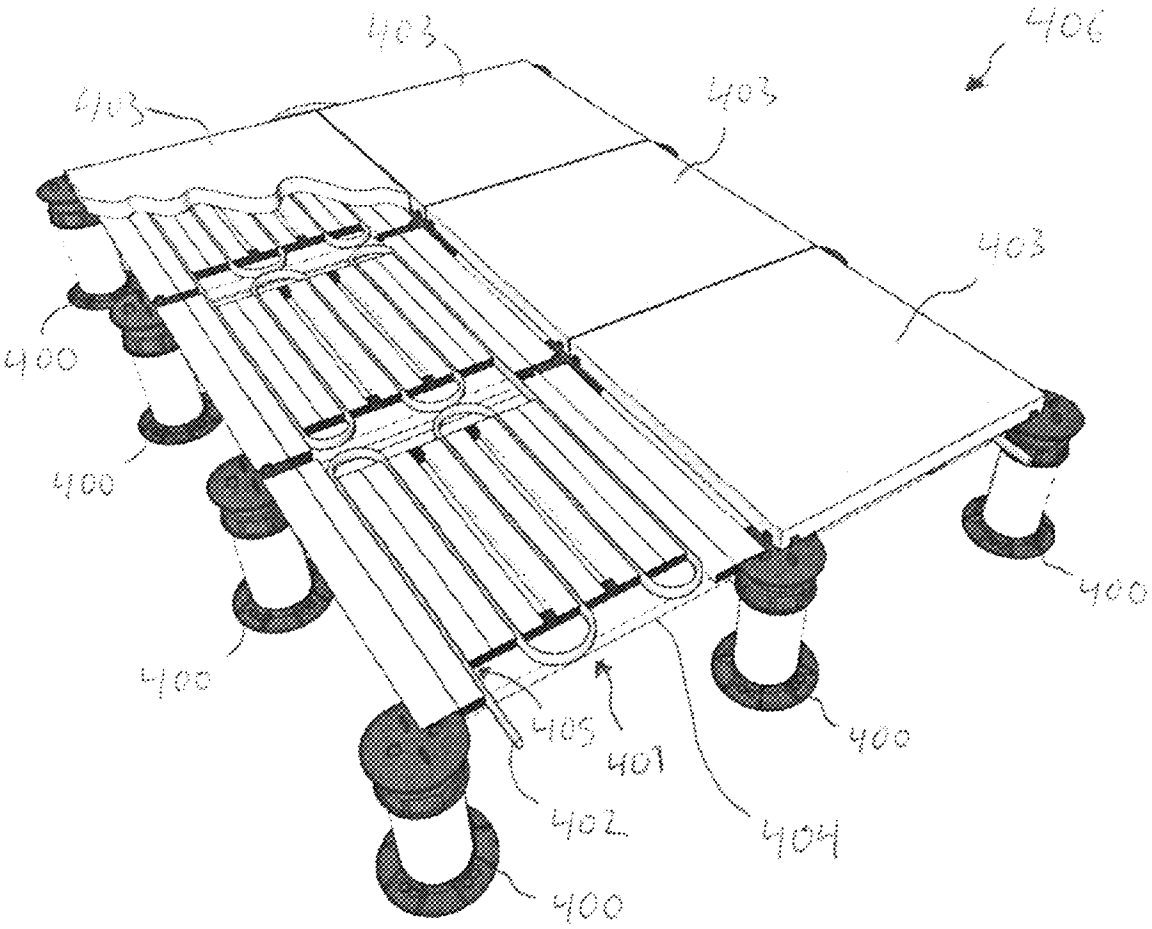
FIG. 4 is a 3D perspective of an example pedestal mounted paver heating system.

FIG. 4 is an illustration of an example embodiment of PMPH system 406 or use with deck or patio installation of pavers 403 over pedestals 400. The PMPH system may include a plurality of assemblies of support trays 401 with heating cables 402. The cutaway view of FIG. 4 shows the PMPH system 406 mounted on pedestals 400 under the pavers 403. To provide efficient heat transfer to the pavers 403, the PMPH system 406 consists of high wattage electric heating cable 402 within an aluminum support tray 401 and slots 405 designed to tit the cable 402, allowing efficient and uniform heat transfer through the paver 403 to the top surface. The PMPH system 406 may utilize heating cable 402 with power output necessary for heavy snow load areas.

As shown in FIG. 4, multiple individual assemblies of the PMPH system 406 may be combined to form a larger surface area for constructing a deck or patio. In some embodiments, the use of self-tapping, threaded fasteners may enable customized modification during installation. The specific positioning of the fasteners on the support tray 401 assembly allows for easy field-removal of one or both of the support tray's two end pieces 404 (stiffeners) in order to perform field-cuts to reduce the support tray 401 overall length. The fasteners that are still in place on the end piece that has not been removed continue to securely hold the aluminum slots in place and maintain the original width of the heating cable slots 405. Once field modifications are complete, the self-tapping fasteners can be quickly and easily installed without the need to predrill holes.

Figure 5:
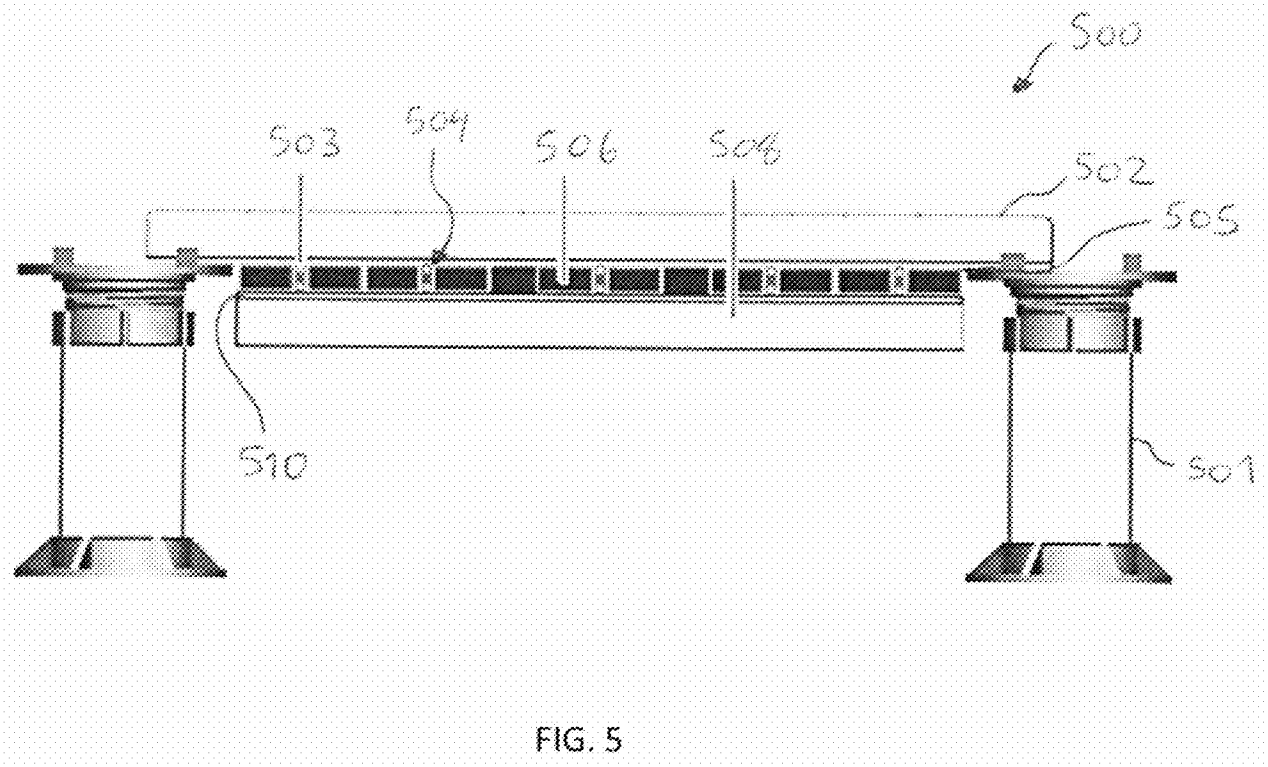
FIG. 5 is a side view of an example pedestal mounted paver heating system.
Figure 6:
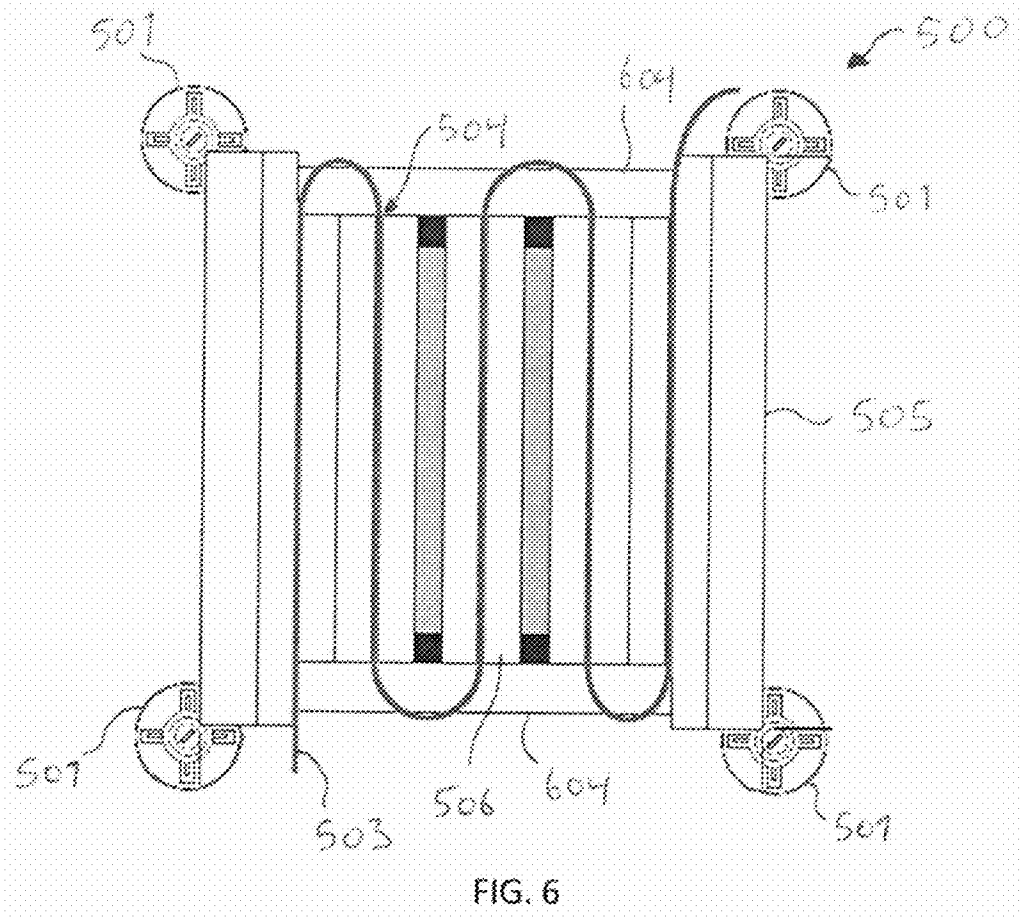
FIG. 6 is a top view of a cable within a support tray on pedestals.

FIG. 5 shows a side view and FIG. 6 shows a top view of an assembly 500 within the PMPH system 406 of FIG. 4, installed on pedestals 501 and supporting a paver 502. FIG. 5 demonstrates how the PMPH system protects a heating cable 503 from mechanical damage from the paver 502 or from the weight of people walking on it. For example, the heating cable 503 may fit within a slot 504 formed between supportive structures 506, leaving a space between the heating cable 503 and an underside surface of the paver 502. Again, insulation 508 installed below a base 510 of the support tray prevents heat generated by the heating cable 503 from escaping through the bottom of the assembly. FIG. 6 shows that the slots 504 in the assembly 500 are designed in a configuration that facilitates installation of the heater cable 503 in a horizontally-oriented pattern that provides efficient and uniform heat transfer across a paver surface. This design enables high performance and a reliable long term solution for heavy snow load areas. FIGS. 5 and 6 also show how the horizontal support plates 604 (i.e., stiffeners) and support wings 505 cooperate to enable routing of the heater cable 503 from underneath one column of pavers to the next column without cutting and terminating the heater cable 503 for each column.

Figure 7:
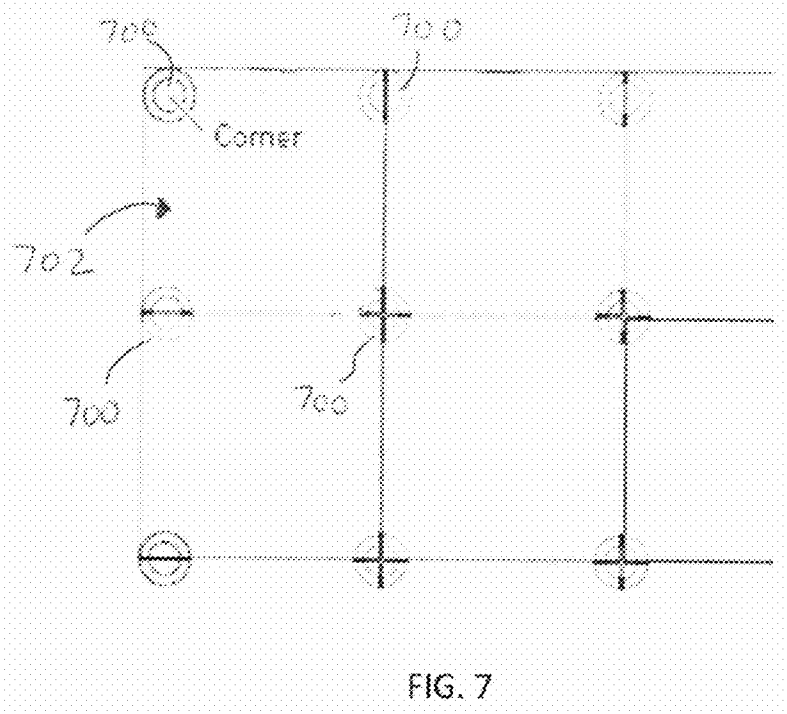
FIG. 7 is a top view of a method of arranging the pedestals for the paver heating system.
Figure 8:
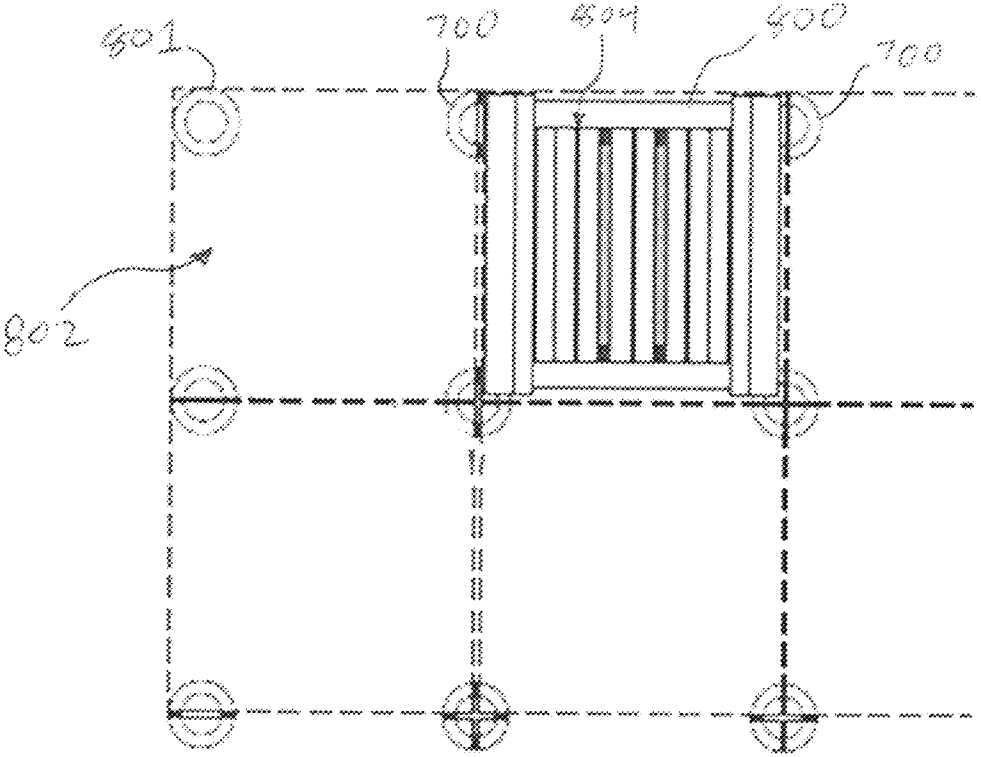
FIG. 8 is a top view of a method of arranging cable support trays on a series of pedestals.

The PMPH system is designed to use a specific method of assembly that enables the system to accommodate different sized decks or patios. FIG. 7 shows a first step in this assembly method. A first row of pedestals 700 or deck supports are placed at an appropriate distance apart to create the foundation; for example, the pedestals 700 are placed at corners of adjacent squares to form columns and rows of cells 702 demarcating the deck/patio area. The pedestals 700 should be level to provide a level deck or patio surface. Any tabs (not shown) on the pedestals may need to be removed from pedestals 700 on the perimeter or corners as necessary. Referring to FIG. 8, once the pedestals 700 are placed and arranged properly, the first PMPH support tray assembly 800 may be installed on the pedestals 700. The first PMPH support tray 800, and additional trays as described below, can be installed with the corresponding slots 804 oriented in the desired direction of the heating cable path. In some embodiments, as shown in an example in FIG. 8, the PMPH tray assembly 800 can't be installed on cells within the columns at the edge of the patio/deck area, such as within corner cell 802 of FIG. 8, unless the pedestals 801 along the edge are cut in half longitudinally to fit the PMPH tray assembly 800.

Figure 9:
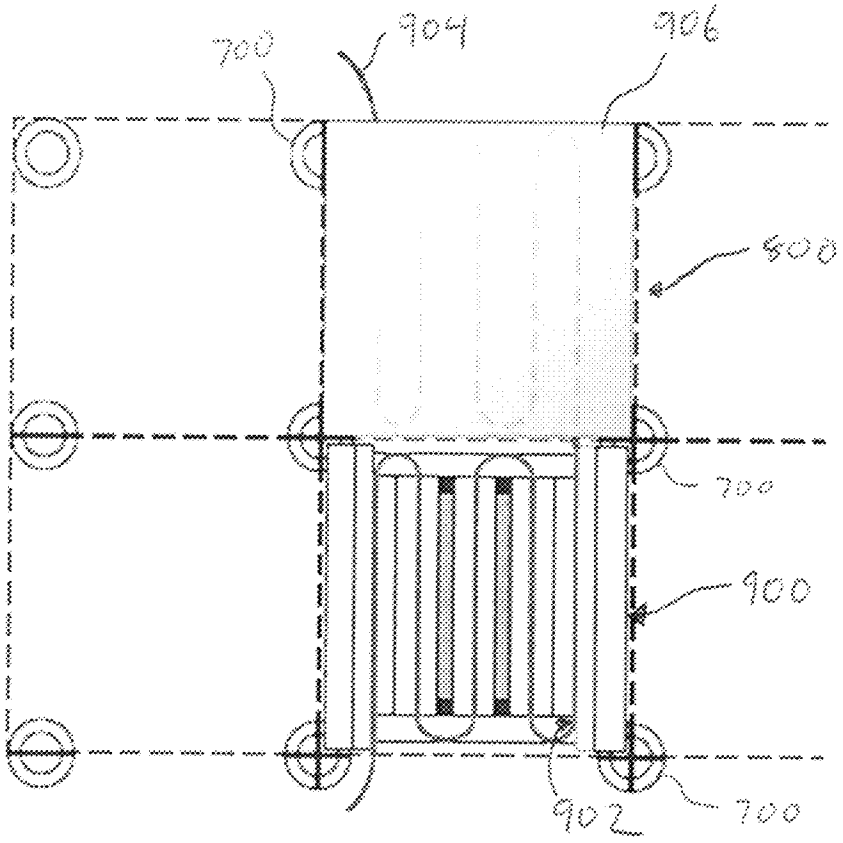
FIG. 9 is a top of view of another step in assembling the pedestal mounted paver heating system.

Referring to FIG. 9, a second PMPH tray assembly 900 may be installed in the cell adjacent to the first PMPH tray assembly 800; this process may be repeated for all eligible cells. In some embodiments, such as the illustrated example, the PMPH tray assemblies may be installed so that their corresponding slots align with each other, facilitating installation of a single heating cable across multiple PMPH tray assemblies. Once the PMPH tray assemblies have been installed in the desired locations, the heating cable 904 can be added. The heating cable 904 can be installed in the slots 804 of the first PMPH cable support tray assembly 800, forming the desired pattern (e.g., the serpentine pattern of FIG. 9). FIG. 9 shows an example embodiment of a single heating cable 904 installed in adjacent PMPH tray assemblies 800, 900: at the end of the pattern within the first PMPH tray assembly, the heating cable 904 extends out of the last slot 804 and into a first slot 902 of the second PMPH tray assembly; the heating cable 904 can then be "snaked" through the remaining slots 902 of the second PMPH tray assembly, again forming a (same or different) pattern for efficient heat delivery. In this system, multiple runs of heating cable 904 may be connected together to form a continuous cable that may span a number of PMPH tray assemblies, such as in FIG. 9. Where the heating cable 904 is first installed in the first PMPH tray assembly 800 before installing the second PMPH tray assembly 900, this mays require aligning the PMPH tray assembly 900 with the cable 904, and installing the heating cable 904 coming from the first PMPH tray assembly 800 in the slots 902 of the second PMPH tray assembly 900. During installation it may be important to ensure that the heating cable 904 is secured in each PMPH tray assembly 800, 900 so that the heating cable 904 does not get damaged by the weight of the pavers installed over the PMPH tray assemblies.

Figure 10:
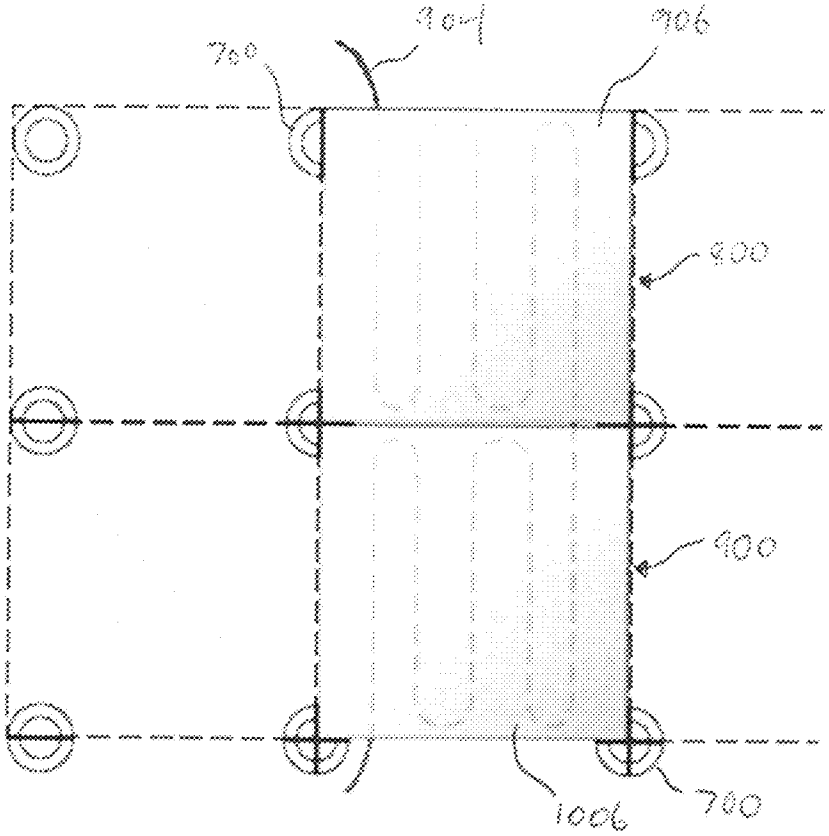
FIG. 10 is a top of view of another step in assembling the pedestal mounted paver heating system.
Figure 11:
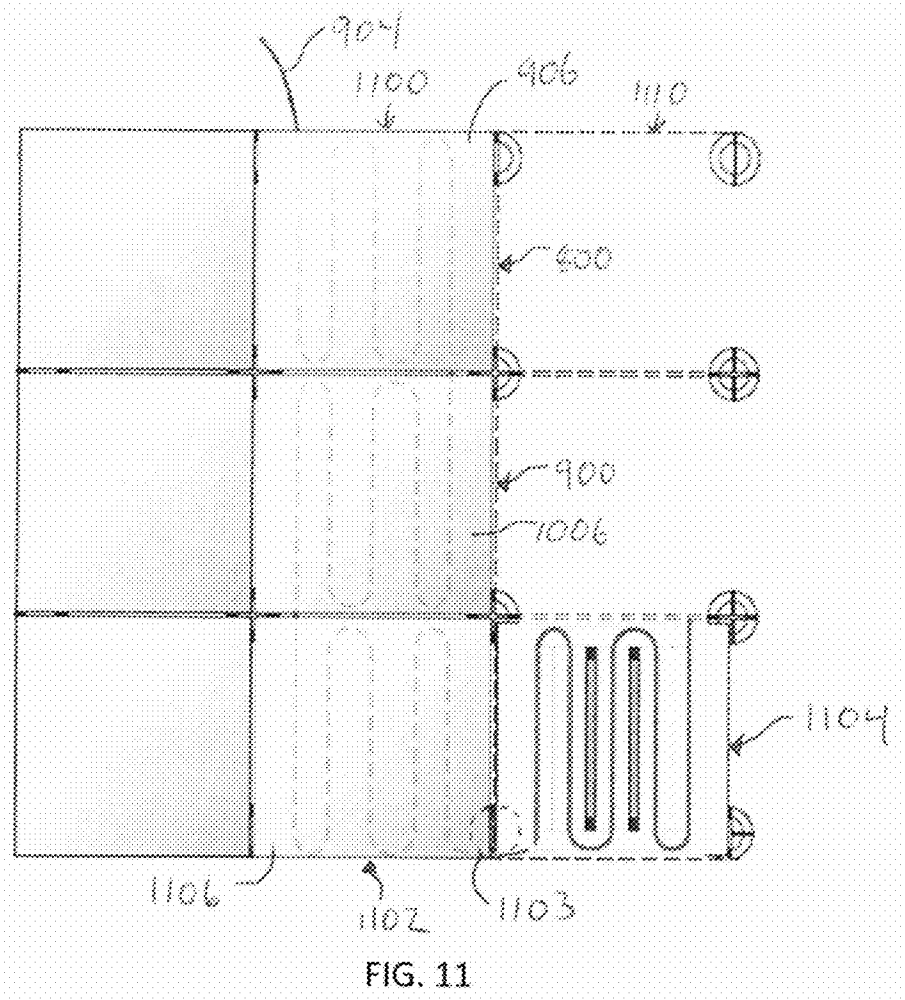
FIG. 11 is a top of view of another step in assembling the pedestal mounted paver heating system.

As shown in FIGS. 9-11, once (or as) the PMPH tray assemblies are installed on the pedestals 700 and the heating cable(s) 904 is/are installed in the PMPH tray assemblies, pavers may be added to form the walking surface of a deck, patio, walkway, etc. Referring again to FIG. 9, a paver 906 can be installed over one PMPH tray assembly 800. Alternatively, a paver may be installed over multiple assemblies. The paver 906 may be installed on the pedestal 700 and PMPH system using appropriate tools (or no tools). The paver 906 may be leveled per the paver manufacturer's installation manual. The paver 906 in FIG. 9 is illustrated to show the configuration of the heating cable 904 underneath. Referring to FIG. 10, a second paver 1006 may be installed over the second PMPH tray assembly 900, and so on, to complete a column of pavers 906, 1006. Referring to FIG. 11, before the last paver 1106 in a column 1100 is installed, the installer may consult a detailed cable layout drawing, if available, to see if the end termination for the cable 904 is at the end of the column 1100 being created. Generally at least a portion of heating cable 904 should be reserved from installation in order to accommodate electrical connections or terminations. If additional columns of pavers are going to be installed, the heating cable 904 may be transitioned to the next column from under the last PMPH tray assembly 1102 and around the pedestal 1103 into the first PMPH tray assembly 1104 of the next adjacent column 1110, as depicted in FIG. 11.

Figure 12:
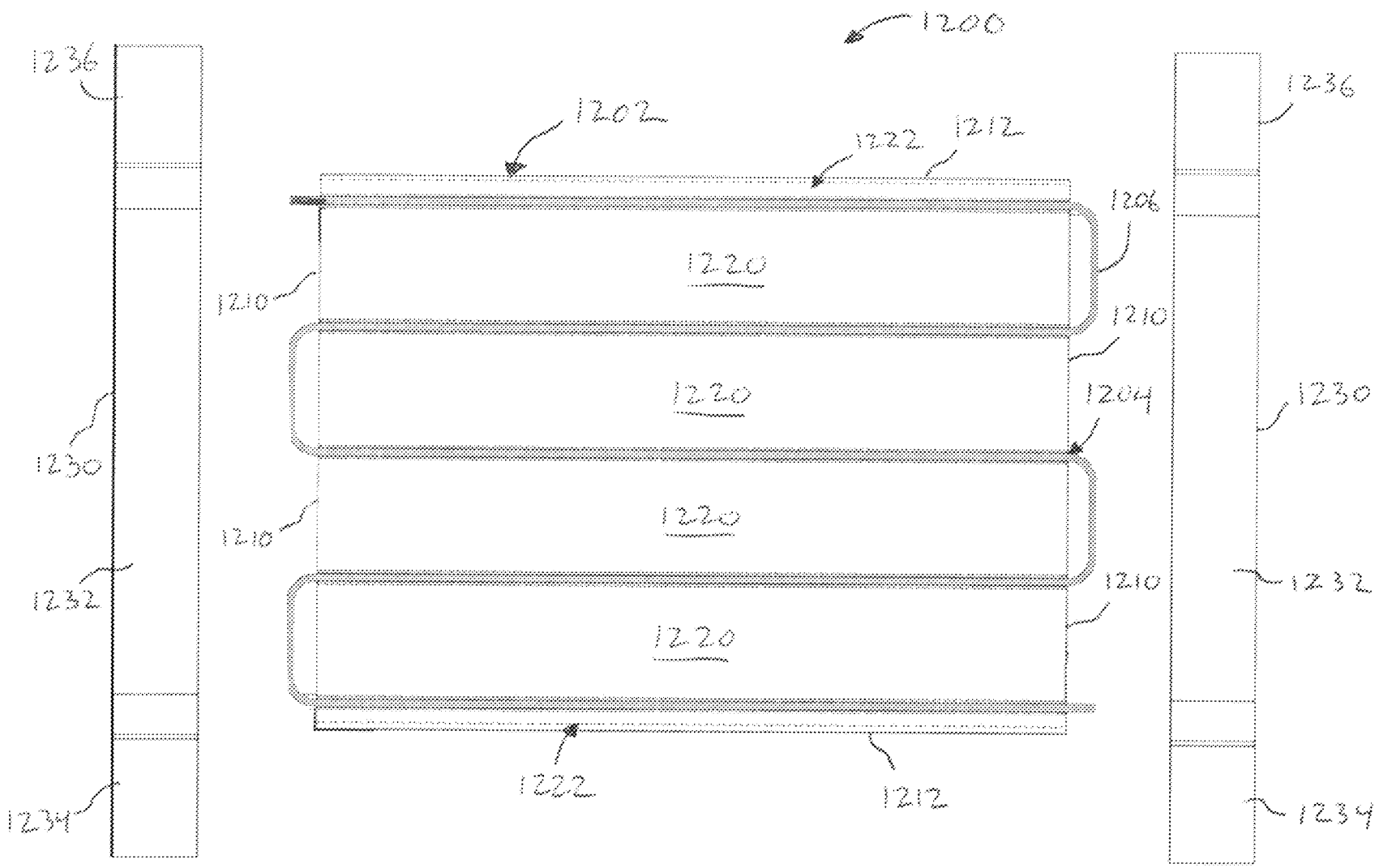
FIG. 12 is a top view of another example embodiment of a pedestal-mounted paver heating system module.

FIG. 12 illustrates another example embodiment of a PMPH system module 1200. The module can include a support tray 1202 that, as described above, includes slots 1204 for retaining a heating cable 1206 in a desired pattern for heating a paver. As described further below, the slots 1204 may be formed into the insulation layer itself. See FIGS. 13A-C In place of the extruded tubes of the example module of FIGS. 1-11, the supportive structures e include a plurality of cover members 1210, 1212 formed of conductive sheet metal or extruded metal. The cover members 1210, 1212 can together form a cover that structurally reinforces and protects the insulation layer, including the slots 1204 as described further with respect to FIGS. 13A-C. Additionally, each cover member 1210, 1212 may include a planar top surface 1220, 1222; collectively, the top surfaces 1220, 1222 of the cover members 1210, 1212 can define an upper surface of the module 1200 which contacts a paver installed over the module 1200.

The module 1200 can further include one or more support brackets 1230 that serve the function of the support wings described above with respect to FIGS. 1-11, suspending the module 1200 from a plurality of pedestals. A support bracket 1230 can include a base 1232 that extends beneath the tray 1202, wings 1234, 1236 that rest on the pedestals and can further form part of the upper surface of the module 1200, and other support members as described below. The support bracket(s) for a module 1200 can be removable; the brackets 1230 can remain in place by friction/tension fit, or can be mechanically attached to the base of the support tray 1202 by fasteners or adhesives.

Figures 13A, 13B, 13C:
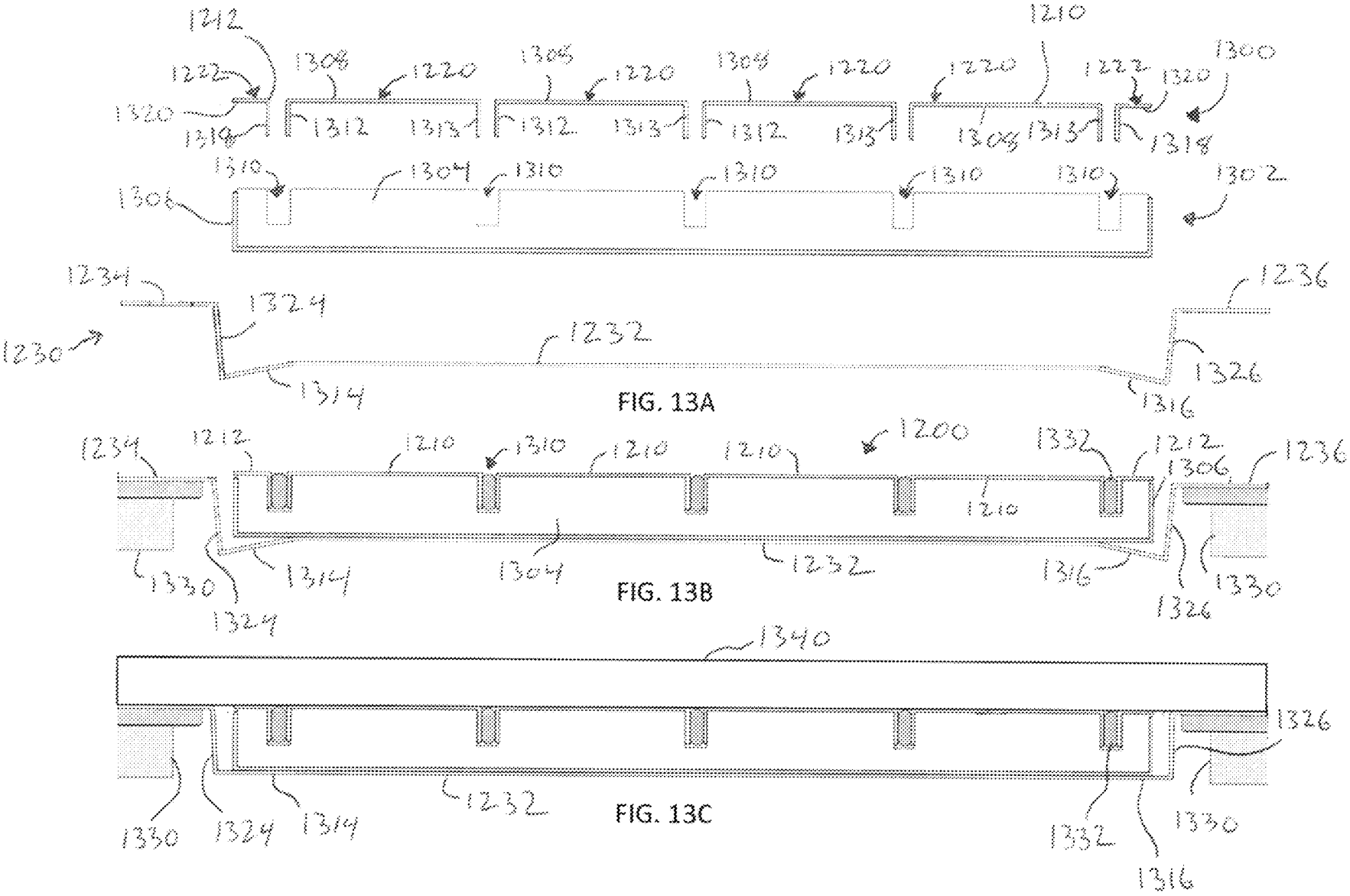
FIGS. 13A-C are front views of the example pedestal-mounted paver heating module of FIG. 12.

FIGS. 13A-C provide a progressive illustration of assembling the module 1200 in place on a plurality of pedestals 1330 and supporting a paver 1340. Referring to FIG. 13A, a cover layer 1300 comprising the cover members 1210, 1212 can be formed over a support layer 1302 comprising an insulation layer 1304 (e.g., closed-cell foam or another thermal insulation as described above) within a support tray 1306. A plurality of slots 1310 can be formed into the insulation layer 1304 at the desired spacing. Internal cover members 1210 may be c-shaped sheet metal or extruded metal members extending the length of the support tray 1306 and insulation layer 1304. A top portion 1308 including the top surface 1220 may span the distance between adjacent slots 1310. Side portions 1312, 1313 may extend from the ends of the top portion 1308; as shown, the side portions 1312, 1313 may be installed into corresponding slots 1310, such that a first side portion 1312 and a second side portion 1313 of adjacent internal cover members 1210 abut the walls of the slot 1310 between them. Similarly, edge cover members 1212 may be L-shaped sheet metal or extruded metal members extending the length of the support tray 1306 and insulation layer 1304. A top portion 1320 including the top surface 1222 may span the distance from a slot 1310 nearest the edge of the support tray 1306 to the edge of the support tray 1306. A side portion 1318 may extend from the end of the top portion 1320 into the corresponding slot 1310.

In this manner, as shown in FIG. 13B, side walls of the slots 1310 are all contacted by part of the cover layer 1300. When a heating cable 1332 is installed in the slots 1310 as described above, the sides of the heating cable 1332 contact the cover members 1310, 1312, and the bottom of the heating cable 1332 is thermally insulated by the insulation layer 1304, directing generated heat upward toward the paver 1340. The cover layer 1300 design can require much less material to implement, compared to the supportive structures of the embodiment of FIGS. 1-11. Additionally, with the slots integrated directly into the insulation layer, the module 1200 can be made thinner than the previously described embodiment.

FIGS. 13A-C also illustrate the operation of the support brackets 1230. For installation over four pedestals 1330, two brackets 1230 can be used, and can be placed between pairs of the pedestals 1330 orthogonally to the desired orientation of the slots 1310, with each wing 1234, 1236 resting on a corresponding pedestal 1330. The support tray 1306 can be placed within the bracket 1230, in contact with the base 1232. At either end of the bracket 1230, a horizontal tension member 1314, 1316 and a vertical tension member 1324, 1326 may each be disposed at an angle, relative to horizontal and vertical, respectively, that causes the upper surface of the module 1200 (i.e., defined by top surfaces 1220, 1222) to be raised slightly higher than the wings 1234, 1236. As shown in FIG. 13C, when a paver 1340 is placed over the module 1200, the weight of the paver straightens the tension members 1314, 1316, 1324, 1326 until they are horizontal/vertical or nearly horizontal/vertical; the wings 1234, 1236 may then be in contact with the paver 1340.

Figure 14:
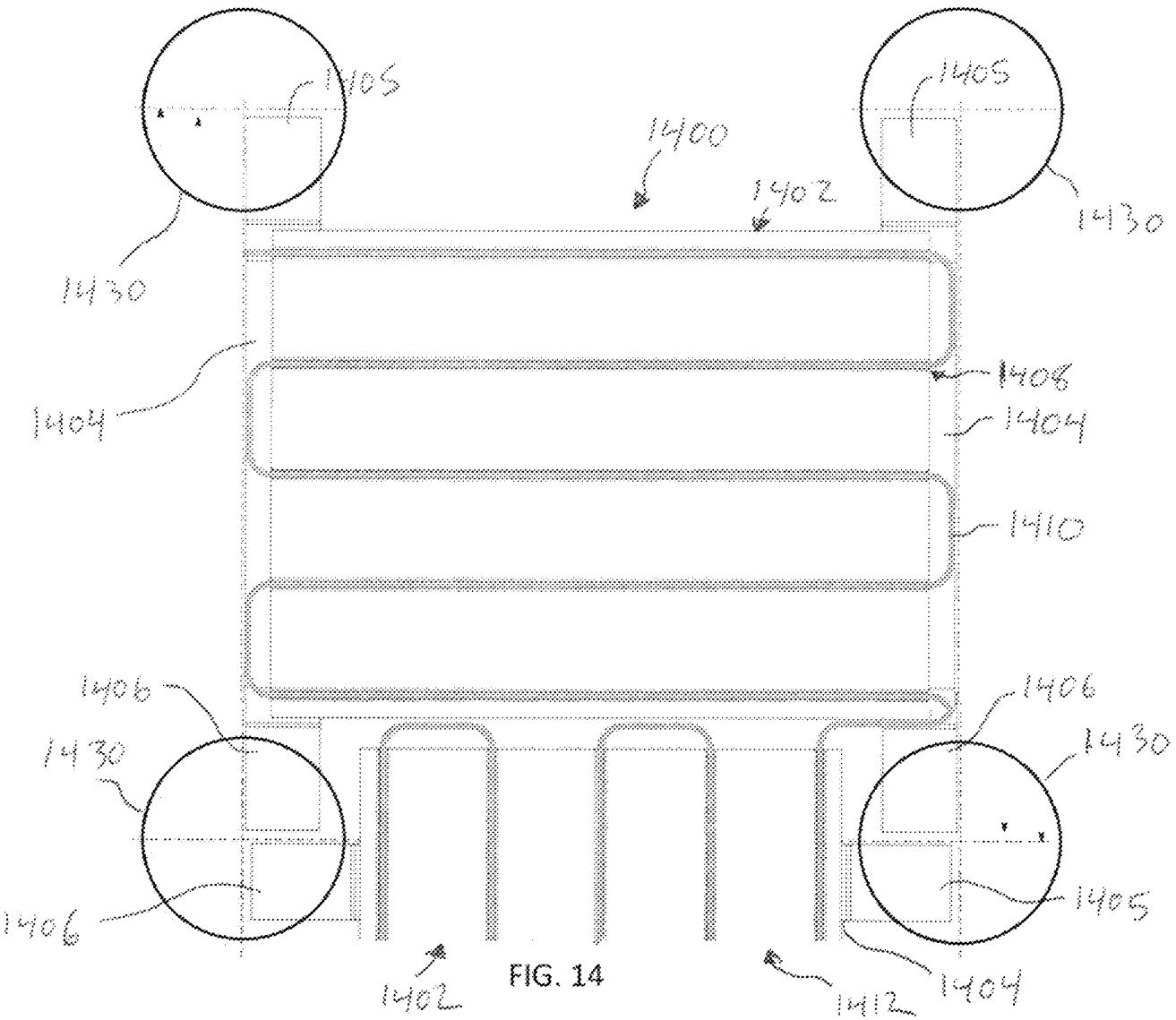
FIG. 14 is a top view of another method of arranging pedestal-mounted paver heating modules on a series of pedestals.

FIG. 14 further illustrates a possible illustration of installing the PMPH system as described above. A first PMPH module 1400 may be disposed in a first orientation (i.e., with slots 1408 of the support tray 1402 extending horizontally across the page); the corresponding wings 1405, 1406 of two support brackets 1404 may be aligned to the center of adjacent pedestals 1430 as shown, which can cause the support brackets 1404 to extend beyond the edges of the support tray 1402 when the support tray 1402 is positioned over the support brackets 1404. An adjacent second PMPH module 1412 may be installed with its support tray 1402 in an orthogonal orientation to the support tray 1402 of the first. PMPH module 1400. The corresponding support brackets 1404 of the second PMPH module 1412 may thus be orthogonal to the support brackets 1404 of the first. PMPH module 1400; as shown, when a first support bracket 1404 is aligned with the center of the pedestals 1430 that the first PMPH module 1400 is already installed on, the support bracket 1404 is disposed inward from the edge of the corresponding support tray 1402. Such flexibility in the longitudinal position of the support bracket 1404 allows for closer spacing of the PMPH modules 1400, 1412 and also simplifies field modifications, such as shortening the support tray 1402, insulation layer, and cover members.

Figure 15:
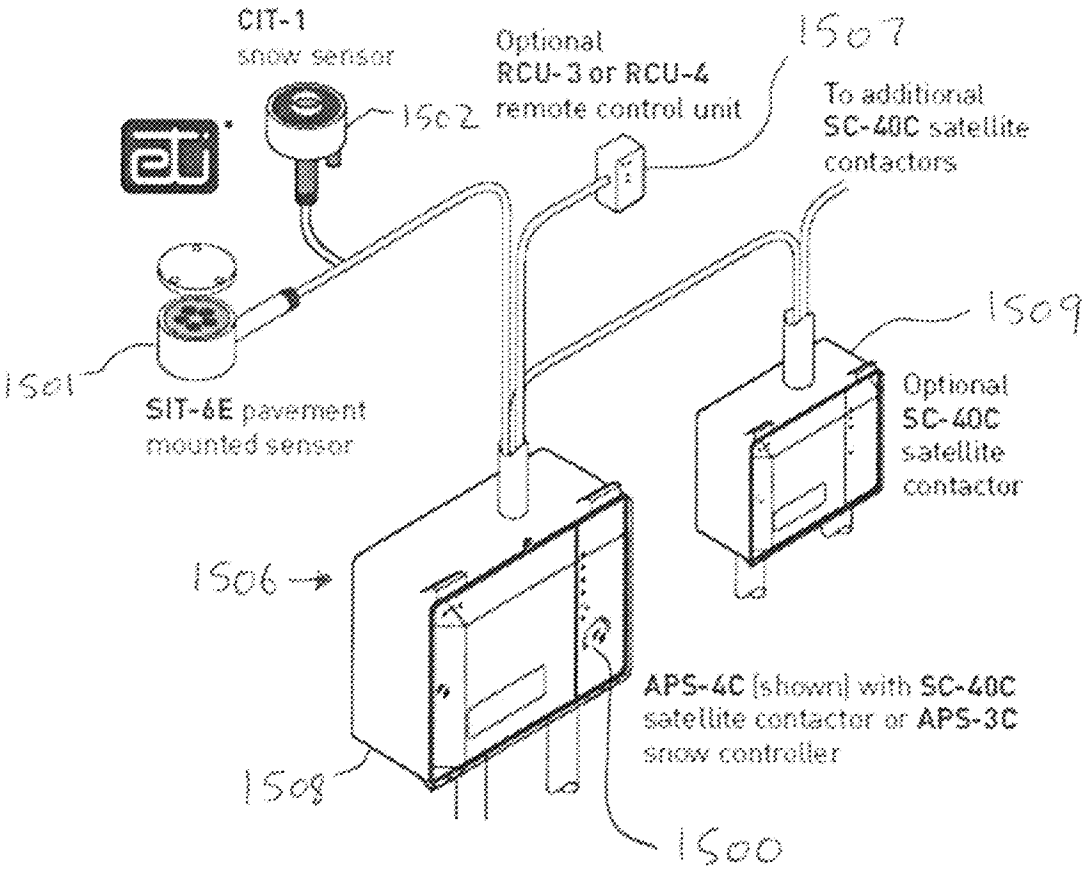
FIGS. 15-17 are diagrams of an example control system for the pedestal mounted paver system.

There are a number of control systems that may be used with the MINI system. FIG. 15 illustrates a number of these control systems, including a manual on/off control 1500, a slab sensing thermostat 1501, and an automatic snow controller 1502 that can be used in the system together or individually.

All three control methods may require contactors 1503 appropriately sized to carry the load. Each method may offer a trade-off balancing initial cost versus energy efficiency and ability to provide effective snow melting. For example, if the system is not energized when required, snow will accumulate. If the system is energized when it is not needed, there will be unnecessary power consumption. Typically a control method may be chosen that best meets the project performance requirements.

In some embodiments, a manually controlled system may be operated by a switch 1500 that controls the system power contactor. This method may require constant human supervision to work effectively. A manual system could also be controlled by a building management system. Embodiments that use a slab sensing thermostat 1501 can be used to energize the system whenever the slab temperature is below freezing. This may not be energy efficient when used as the sole means of control, and in some embodiments may be used in conjunction with other control methods. A slab sensing thermostat 1501 is effective for all surface snow melting and anti-icing applications, and is particularly beneficial for paver installations. For example, when used with pavers, the slab sensing thermostat 1501 may prevent surface damage due to overheating. The electronic slab sensing thermostat 1501 can monitor the temperature of a surface and control whether the heating cables are turned on or off. A temperature threshold may be set, such that when the temperature of the slab drops below the set value the heating cables are turned on to heat the slab. In some embodiments, the temperature set point and LED indicators for alarm, power, and heating cable status can be visually checked on a the thermostat device 1506.

Some embodiments may use an automatic snow controller. The snow melting system may be automatically energized when both precipitation and low temperature are detected. When precipitation stops or the ambient temperature rises above freezing, the system is de-energized. The automatic snow controller may work cooperatively with a slab sensing thermostat 1501. For example, a slab sensor 1501 may de-energize the system after the slab reaches the slab sensing set point even if freezing precipitation is still present Using an automatic snow controller with a slab sensor 1501 may offer a more energy-efficient control solution. For areas where a large number of circuits are required, the Surface Snow Melting control mode some embodiments may include an external device control option 1507. This option may allow a Snow/Moisture sensing controller to be integrated into the embodiment of the system.

In some embodiments, an automatic snow melting, controller may be housed in an enclosure 1508 to provide effective, economical, automatic control of all snow melting applications. Some embodiments may be available in 120 V and 208-240 V, 50/60 Hz models. The automatic snow melting controller may include a 24-Amp DPDT output relay, adjustable hold-on timer, and integral high limit temperature sensor with an adjustable range of 40° F. to 90° F. (4° C. to 32° C.). For larger deck or patio applications, some embodiments may operate multiple satellite contactors 1509 capable of managing larger loads.

Other control method embodiments may include a number of sensors. For example, an overhead snow sensor 1502 that detects precipitation or blowing snow at ambient temperatures below a specified temperature may be used with an automatic snow melting controller in some embodiments. In other embodiments, the slab sensor 1501 may be a pavement-mounted sensor that signals for the heating cable to turn on when the pavement temperature falls below a specified temperature and precipitation in any form is present. In these embodiments, microcontroller technology may be used in the control devices to effectively eliminate ice bridging while ensuring accurate temperature measurement.

Some embodiments may provide control and status displays to a controller 1507 from a remote location.

Figure 16:
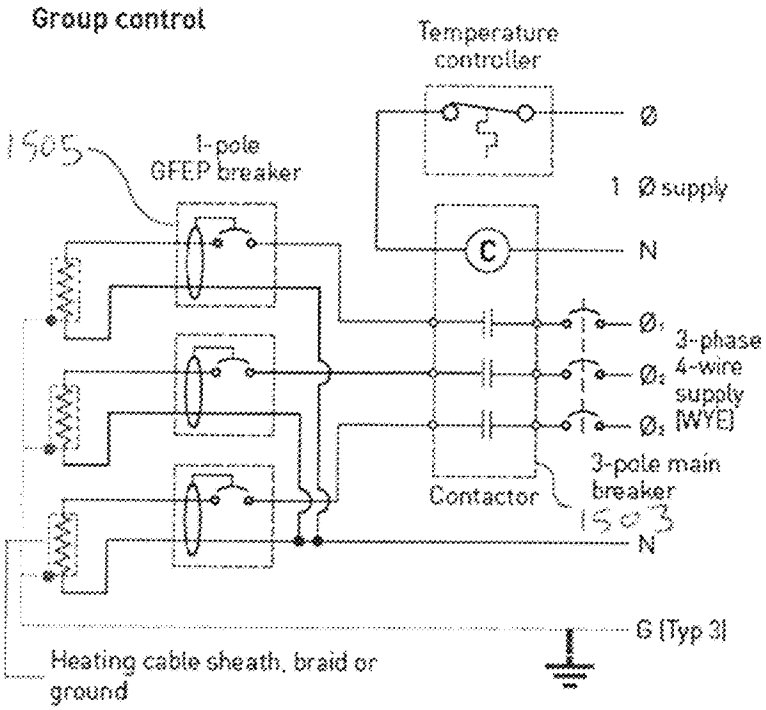
Figure 17:
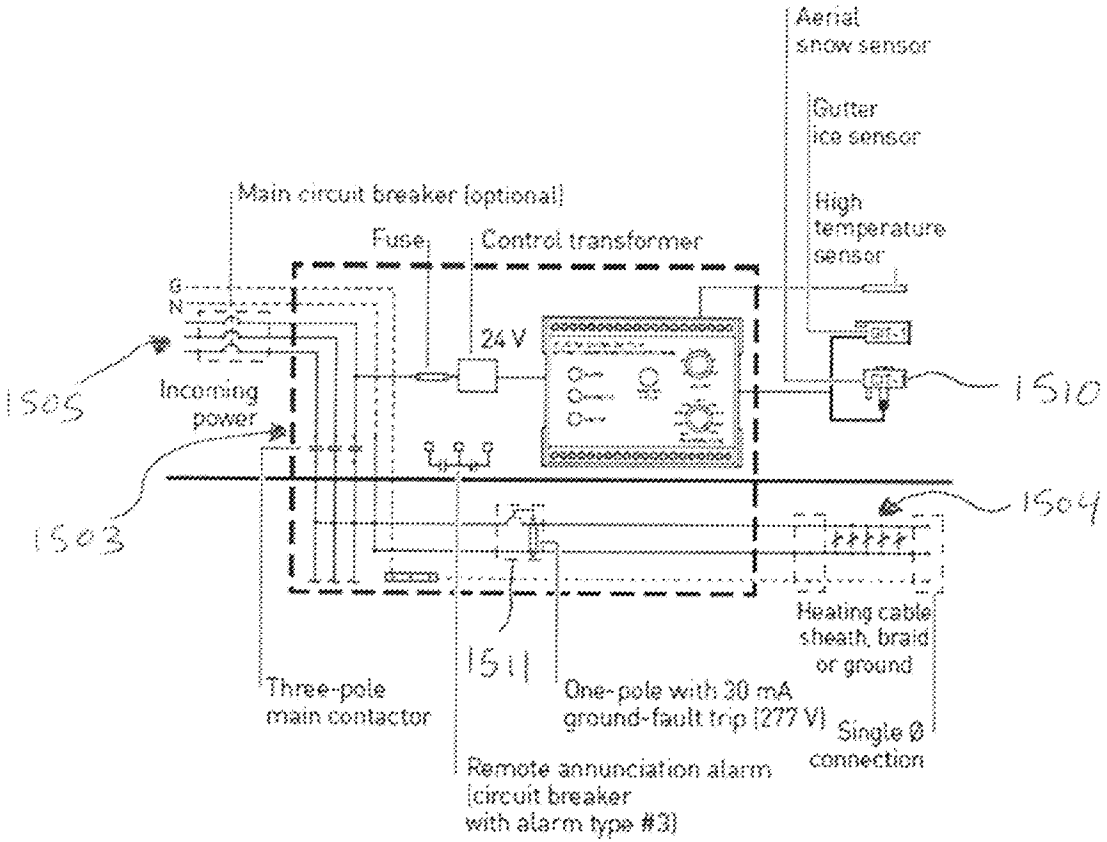

FIG. 16 shows typical wiring schematics for example embodiments of single and group control systems; FIG. 17 shows a typical wiring schematic for an example embodiment of large systems with many circuits. Generally, control systems embodiments may include single-phase power distribution panel that includes a primary circuit breaker 1505, switch-controlled power contactor 1503, ground-fault protection 1511, monitoring, and control for snow melting systems. Single-phase voltages may include 208 and 277 V.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

We claim:

1. A pedestal mounted paver heating (PMPH) system for heating one or more thermally conductive pavers installed on pedestals to form a walking surface, the PMPH system comprising:

a plurality of support trays each comprising:

a base formed of thermally conductive sheet metal and sized to rest on the pedestals beneath a corresponding paver of the one or more pavers;

an insulation layer disposed to reduce heat loss through the base, the insulation layer including a plurality of slots; and a plurality of thermally conductive supportive structures positioned over the insulation layer and extending into the plurality of slots, the plurality of thermally conductive supportive structures physically separated from each other so that each of the plurality of slots extends between two adjacent thermally conductive supportive structures of the plurality of thermally conductive supportive structures; and a self-regulating heater cable electrically connecting to a power supply and disposed within a first support tray and a second support tray of the plurality of support trays, the plurality of slots of the first support tray defining a path of the heater cable that positions the heater cable relative to the walking surface in order to transfer heat from the heater cable through the one or more pavers to the walking surface.

2. The PMPH system of claim 1, wherein the plurality of slots of the first support tray have a slot width selected to:

allow the heater cable to be fully inserted by a system installer into the plurality of slots, such that the heater cable does not contact a first paver, of the one or more pavers, installed over the first support tray; and retain the heater cable within the plurality of slots.

3. The PMPH system of claim 2, wherein the slot width is further selected to maximize contact of the heater cable with the plurality of supportive structures.

4. The PMPH system of claim 1, wherein:

the first support tray further comprises a planar upper surface defined by the corresponding plurality of supportive structures and contacting the corresponding paver installed over the first support tray; and the corresponding base of the first support tray comprises a first support wing and a second support wing each extending away from the corresponding plurality of supportive structures at the upper surface of the first support tray, the first support wing and the second support wing contacting the pedestals and further defining the upper surface of the first support tray when the corresponding paver is installed over the first support tray.

5. The PMPH system of claim 4, wherein the first support wing and the second support wing:

extend away from the corresponding plurality of supportive structures at an angle with respect to horizontal, such that the first and second support wings dispose the upper surface of the first support tray above the pedestals when the first support tray is positioned on the pedestals; and are configured to flatten into a horizontal position and further define the upper surface when the corresponding paver is installed over the first support tray.

6. The PMPH system of claim 1, further comprising a controller in electrical communication with one or both of the power supply and the heater cable, the controller comprising a processor and memory storing machine-readable program instructions that, when executed by the processor, cause the controller to receive control signals and energize and de-energize the heater cable in response to the control signals.

7. The PMPH system of claim 6, further comprising one or more sensors in electronic communication with the controller and configured to detect snow or ice on the walking surface and send one or more of the control signals to the controller.

8. The PMPH system of claim 1, wherein the first support tray further comprises two end pieces attaching to the base and extending parallel to each other across at least a portion of the base, the end pieces comprising a rigid material selected to stiffen the support tray sufficiently to support the corresponding paver.

9. The PMPH system of claim 8, wherein a first end piece of the two end pieces is removable and re-attachable to the base, and the sheet metal of the base can be cut by a system installer, such that the first support tray can, at a location of the walking surface, be cut to a desired length to support a partial paver of the one or more pavers.

10. The PMPH system of claim 9, wherein the two end pieces extend perpendicular to the corresponding plurality of supportive structures, and the corresponding plurality of supportive structures can be cut by the system installer at the location of the walking surface.

11. The PMPH system of claim 1, wherein each of the plurality of thermally conductive supportive structures is c-shaped.

12. The PMPH system of claim 1, wherein each of the thermally conductive support structures comprises:

a top member that forms part of a planar upper surface of one of the plurality of support trays; and at least one side member extending from the top member into a corresponding slot of the plurality of slots.

13. The PMPH system of claim 1, wherein each of the plurality of slots includes side walls, and the plurality of thermally conductive support structures extend into the slots to abut the side walls.

14. The PMPH system of claim 1, wherein the plurality of slots of the first support tray extend in a first direction and the plurality of slots of the second support tray extend in a second direction orthogonal to the first direction.

* * * * *